United States Patent [19]

Lunden

[11] 4,278,955

[45] Jul. 14, 1981

[54] COUPLER FOR FEEDING EXTENSIBLE TRANSMISSION LINE

[75] Inventor: Clarence D. Lunden, FederalWay, Wash.

[73] Assignee: The United States of America as represented by the Secretary of the Air Force, Washington, D.C.

[21] Appl. No.: 123,612

[22] Filed: Feb. 22, 1980

[51] Int. Cl.[3] ..... H01P 5/08

[52] U.S. Cl. ..... 333/33; 333/238; 333/240

[58] Field of Search ..... 333/24, 222, 236, 238, 333/240, 246, 260, 33

[56] References Cited

U.S. PATENT DOCUMENTS

| | | | |
|---|---|---|---|
| 3,639,857 | 2/1972 | Okoshi et al. | 333/238 X |
| 3,882,418 | 5/1975 | Godard et al. | 333/236 X |
| 4,193,047 | 3/1980 | Carter et al. | 333/222 X |

*Primary Examiner*—Paul L. Gensler

*Attorney, Agent, or Firm*—Donald J. Singer; Willard R. Matthews, Jr.

[57] ABSTRACT

An extensible surface wave transmission line is fed through a coupler that utilizes the geometric properties of a planar ellipse. The coupler is in the form of a planar elliptical r.f. cavity with the r.f. input signal being fed to the cavity at the location of one ellipse focus point and the extensible output transmission line slidably traversing the cavity at the position of the other ellipse focus point. The elliptical eccentricity of the r.f. cavity is chosen such that the direct path between the ellipse foci is one half wavelength less than the ellipse major axis (or any indirect path-length between foci) thereby ensuring constructive addition of all input signals at the coupler output. The coupler is adapted to use in conjunction with aircraft antennas, transit and rail system applications, and electrical cable manufacturing quality control systems.

8 Claims, 11 Drawing Figures

FIG. 10
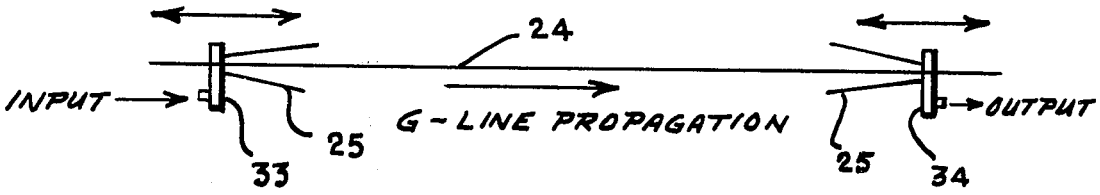
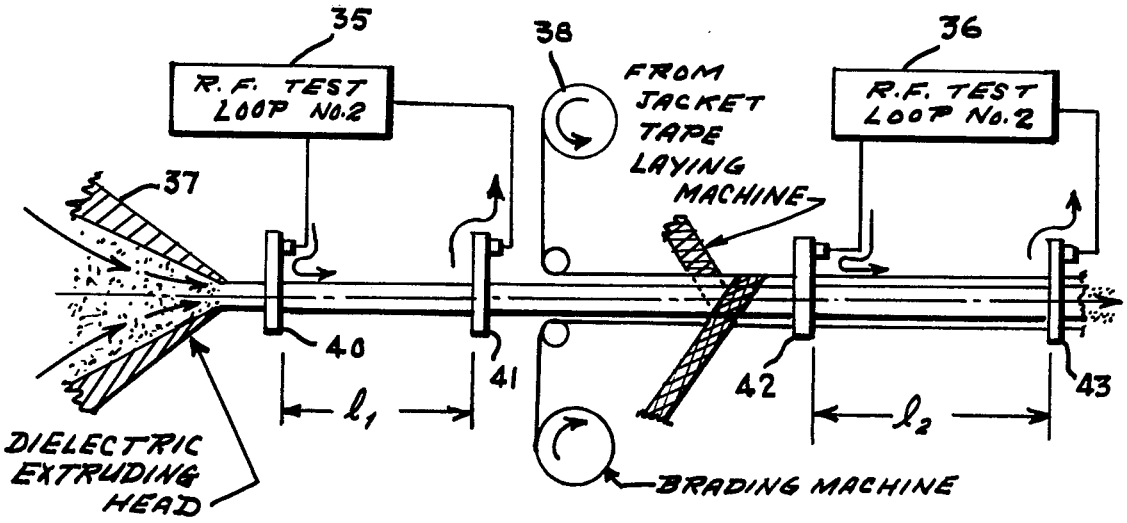
FIG. 11

COUPLER FOR FEEDING EXTENSIBLE TRANSMISSION LINE

STATEMENT OF GOVERNMENT INTEREST

The invention described herein may be manufactured and used by or for the Government for governmental purposes without the payment of any royalty thereon.

BACKGROUND OF THE INVENTION

This invention relates to r.f. couplers and in particular to coupling means for transferring microwave power from a coaxial line input onto a sliding coaxial line output without excessive loss of r.f. power and without the use of wiping contacts.

Situations exist in which it would be convenient and even vital to radiate microwave signals, generated aboard an aircraft, from a point several hundred to one thousand feet aft of the aircraft. In order to get the r.f. signal back to the desired locus of origin a long retractable conductor of convenient dimensions and low drag characteristics is required. The attenuation penalty of a one-half inch cable is greater than 50 db/1000 foot at S band, rising to greater than 0.1 db/foot at X band. This represents a prohibitive loss. Accordingly, there exists the need for a guiding conducting media with losses of less than 10 db/1000 feet. One presently available suitable conducting means is the so-called G-line, the single-wire transmission line described by G. J. E. Goubau in the publication entitled *Single Conductor Surface Wave Transmission Lines,* Processings of the IRE Vol. 89, P619, June 1951.

A problem arises in an operational situation in feeding such a transmission line as it rolls off a storage reel. Continuous r.f. transmission is needed for all positions of the G-line, and reel from the retracted to the fully extended position. For this purpose a coupler for coupling between a stationary launching means and a movable surface waveguide is needed.

In the laboratory and in fixed point to point type installations such as telephone lines, the feed coaxial cable is smoothly and rigidly coupled to the launch horn. In an attempt to accommodate an r.f. feed to an extensible transmission line the coaxial cable-to-stub 90° transition described by Ragan in the MIT Radiation Laboratory Series Volume 9, page 181 has been built with an interior adaptation to permit a sliding conductor in the output ports. However, because the conductor is insulated (a necessary condition for G-line propagation) r.f. enters and escapes through the fine circumferential crack between the transmission line and the coupling device. This not only wastes r.f. power, but if uncontrolled leakage occurs the stated desire to have all of the r.f. energy originate from the tail end of the travel line is violated.

A coaxial-slot surface wave launcher structure has been developed and described in the periodical article entitled *Coaxial-Slot Surface Wave Launchers* by Beal and Dewar Electronics Letters 4:25, Dec. 13, 1968, pp 557–559. This device, however, is basically narrow band and cannot accommodate the sliding G-line in the various applications comprehended herein.

The foregoing summary of the state-of-the-art indicates that there currently exists the need for a coupling means that is capable of coupling r.f. signals from a fixed source to a sliding or extensible transmission line without excessive losses or bandwidth restrictions and without resorting to wiper contacts and the like. The present invention is directed toward satisfying that need.

SUMMARY OF THE INVENTION

The present invention comprehends an r.f. coupler in the form of a planar elliptical r.f. cavity wherein the input signal is applied to one focus of the ellipse and an extensible output transmission line is slidably engaged through an aperture located at the other ellipse focus. The direct distance between ellipse foci is related to the total reflected distance (one focus to ellipse edge to the other focus) in such a way as to ensure constructive addition of all signals at the device output. In one preferred embodiment of the invention the distance between foci is equal to one half wavelength at the operating frequency of the device. The coupler is provided with a launcher horn and tuning is accomplished by means of an r.f. choke on the output transmission line. Gap leakage is reduced by means of a sleeve member that removes the circumferential gap between the output transmission line and the coupler to a high impedance region. The cavity can be fabricated of copper plated circuit board such as copper plated TEFLON GLAS.

It is a principal object of the invention to provide a new and improved r.f. coupler.

It is another object of the invention to provide coupling means for coupling a fixed r.f. source to a sliding transmission line.

It is another object of the invention to provide coupling means for coupling a fixed r.f. source to a sliding transmission line that does not exhibit excessive r.f. power leakage around the slidable output transmission line.

It is another object of the invention to provide coupling means for coupling a fixed r.f. source to a sliding transmission line that is adapted to broadband operation.

It is another object of the invention to provide coupling means for coupling a fixed r.f. source to a sliding transmission line that is adapted to transit and train translation joint applications.

It is another object of the invention to provide coupling means for coupling a fixed r.f. source to a sliding transmission line that is adapted to electrical cable manufacture quality and control systems.

These together with other objects, features and advantages of the invention will become more readily apparent from the following detailed description when taken in conjunction with the illustrative embodiment in the accompanying drawings.

DESCRIPTION OF THE DRAWINGS

FIG. 10 is a schematic illustration of a translational joint system application of the invention; and FIG. 11 is an illustration of an electrical cable manufacture quality and control system application of the invention.

DETAILED DESCRIPTION OF THE PREFERRED EMBODIMENT

Figure 1:
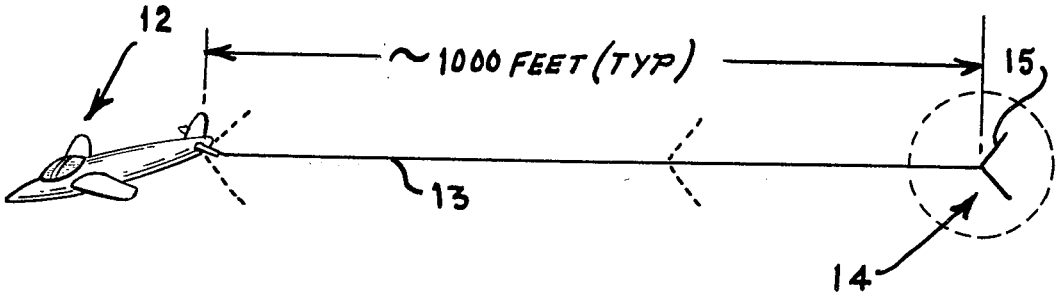
FIG. 1 is a schematic illustration of an extensible transmission line utilized in an aircraft.
Figure 2:
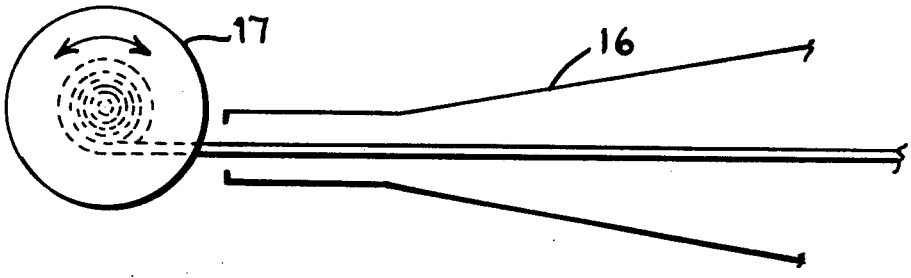
FIG. 2 is a schematic illustration of an extensible transmission line on a storage drum and including a launcher horn.

Referring to FIGS. 1 and 2 there is illustrated thereby a typical need for and application of the coupler of the present invention. As noted above, it is sometimes required to transmit a signal from a point (typically 1000 feet) behind an aircraft. The aircraft 12 of FIG. 1 illustrates this by a trailing transmission line 13 and radiating element 15 which transmits a signal from a point 14 a substantial distance aft. Such a transmission line is conveniently stored on a drum 17 and fed through a launcher horn 16 as illustrated by FIG. 2. The basic problem encountered, however, is that of coupling the input r.f. signal to the extensible transmission line 13 without excessive r.f. signal leakage.

Figure 3:
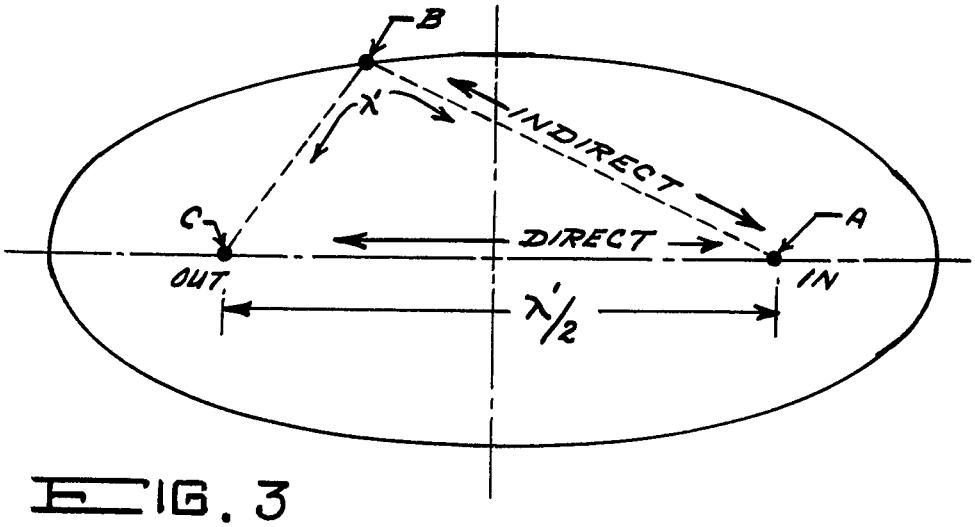
FIG. 3 schematically illustrates the elliptical configuration of the coupler of the invention.

The present invention solves this problem by means of an elliptically configured coupling device. As illustrated in FIG. 3 an elliptic coupler is comprehended which exploits the geometric properties of planar ellipses. In accordance with the principles of the invention the direct in/out path A-C is made to be one half wavelength shorter than the indirect path A-B-C. Because of the elliptical geometry any indirect path A-B-C for a point B anywhere on the ellipse perimeter would be equal to any other and, by definition also equal to the ellipse's major axis. This geometric constraint ensures constructive addition of all direct and indirect rays (and r.f. signals) at the output focus point. The additional phase shift arises from the hard metal short circuits at the bounderies of the ellipse. Furthermore, if the direct path A-C is made equal to one half wavelength (at the device operating frequency) an ellipse of eccentricity $e=\frac{1}{2}$ is defined and a match at that one frequency is ensured.

Figure 4:
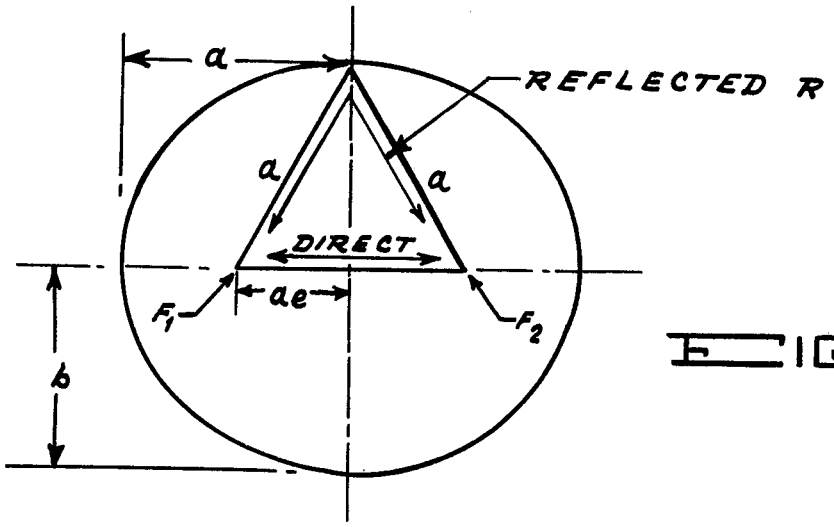
FIG. 4 is an illustration of the ellipse configuration of the invention and specific design parameters.
Figure 5:
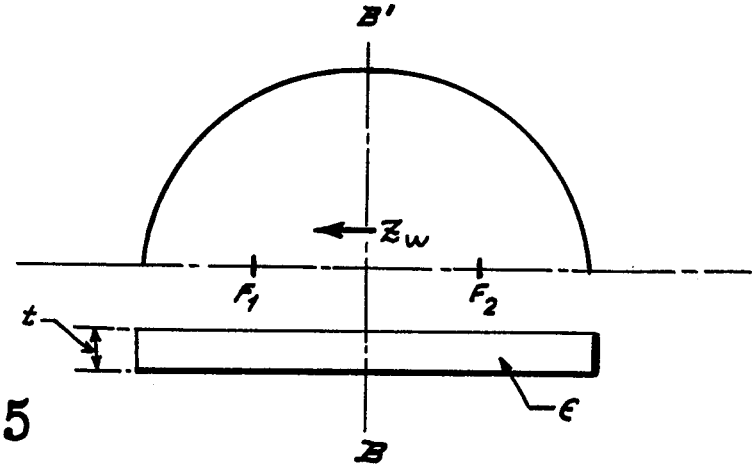
FIG. 5 illustrates design parameters for calculation of coupler thickness.

Referring now to FIGS. 4 and 5 design equations are here developed for a TEM-TEM mode copper clad dielectric coupler of wavelength $\lambda=3$ inches.

The path of direct ray D is set to be one half wavelength less than the reflected ray R, thus:

$$2a - 2(ae) = \frac{\lambda}{2}$$

where the wavelength in the dielectric is $$\lambda = \frac{\lambda o}{\epsilon'}$$

being the dielectric constant: from the ellipse governing equation $$\frac{a\lambda}{2} = \frac{\lambda^2}{16} + b^2$$

If it is further required that $2ae=\lambda/2$ (for matching) Then: ellipse eccentricity $$e=\tfrac{1}{2}$$

$$2a=\lambda \text{ and}$$

$$2b = \frac{\lambda}{2}\sqrt{3} \text{ where } \lambda = \frac{\lambda_0}{\epsilon},$$

At the mid-plane B—B' (FIG. 5) the characteristic impedance $Z_w$ is that impedance associated with a dielectric filled waveguide $$Z_w = \frac{\pi}{2}\ \frac{t}{2b}\ \frac{120\pi}{\sqrt{\epsilon - (\frac{\pi}{2b})^2}}$$

in the constrained ellipse of the present invention $$\lambda/2b=2/3$$

from which the thickness design equation $$Z_w = \frac{\pi}{2}\ \frac{t}{2b}\ \frac{120}{\sqrt{\epsilon - (\frac{\lambda}{2b})^2}}$$

is desired,

By way of example, for Teflon Glas dielectric $\epsilon=2.5$, $$Z_w = \frac{t}{2b} \times [538] \text{ ohms}$$

If sending and receiving impedances are 50 ohm this can be equated to $Z_W$ whence $$\frac{t}{2b} = .093$$

For the example $\lambda=3$ inches $[=2b]$ $$\lambda_o=12 \text{ cm}$$

$$fo=2.5 \text{ Gh}_Z$$

and $$t=0.28 \text{ inches}$$

It has been confirmed that TEFLON-glas copper clad material of around $t\sim0.3$ inches gives the best impedance bandwidth at 2.5 $Gh_z$.

Figure 6:
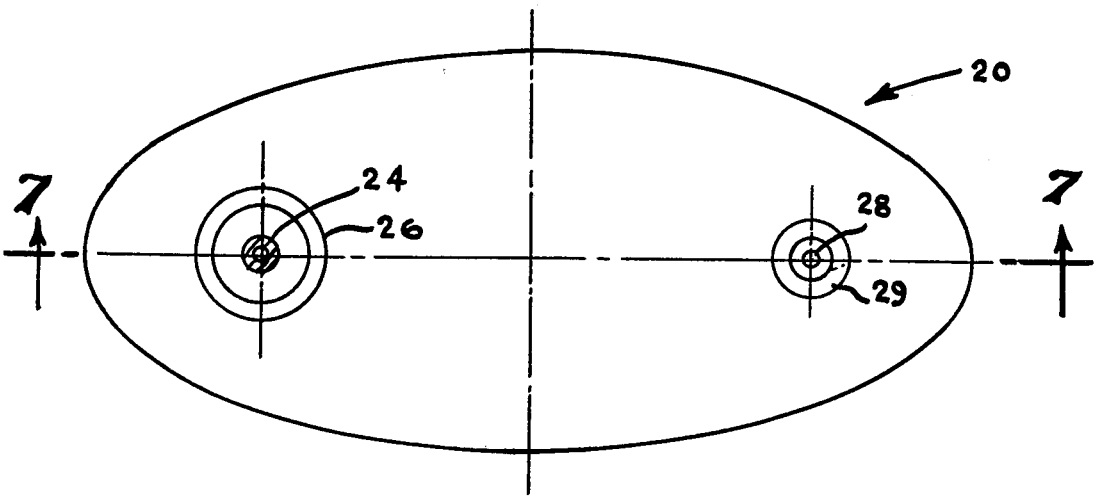
FIG. 6 is a top view of one presently preferred embodiment of the invention.
Figure 7:
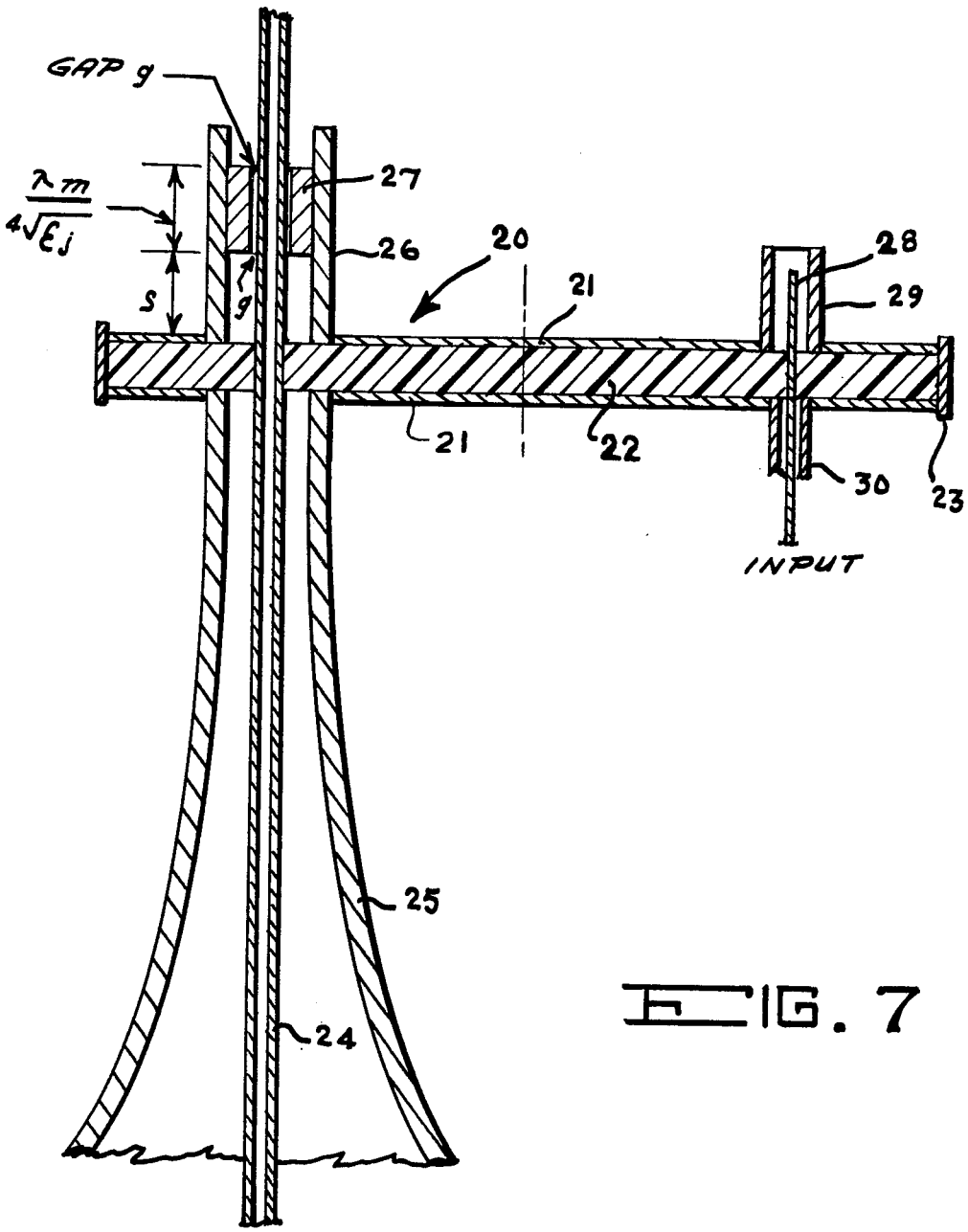
FIG. 7 is a sectional view of the embodiment of FIG. 6 taken at 7—7.

One presently preferred embodiment of this invention is illustrated by FIGS. 6 and 7. It comprises elliptical cavity coupler 20 having its r.f. signal input located at one ellipse focus and extensible tranmission line 24 slidably engaged through the other ellipse focus in accordance with the principles expounded above. Referring now to FIGS. 6 and 7, the coaxial fitting 30 feeds into a resonant quarter wavelength stub 28. Stub 28 is shielded on the far side of the coupler by coaxial sleeve 29. The elliptical cavity 20 is of electrically conductive material and can be filled with a dielectric material. It can conveniently be fabricated as a sandwich printed circuit board 22 having dual copper clad surfaces 21 that is cut out to an appropriate ellipse configuration with the edges being shorted by a copper band 23. R.F. power from the input coaxial cable is coupled by means of cavity 20 to the extensible transmission line which is arranged coaxially inside the neck of the flared launcher horn 25. The extensible transmission line 24 can be any appropriate transmission line such as the G-line of Goubau referenced above. In order to prohibit r.f. signal energy from escaping in the undesired direction (upward in FIG. 7) through gap g a choke 27 is located in coaxial sleeve 26 a distance S from the upper side of the planar surface of elliptical cavity coupler 20. The position of choke 27 is determined by optimizing input matching. For octave band matching S is negative with the slug (choke 27) slightly penetrating into the coupler body.

Figure 8:
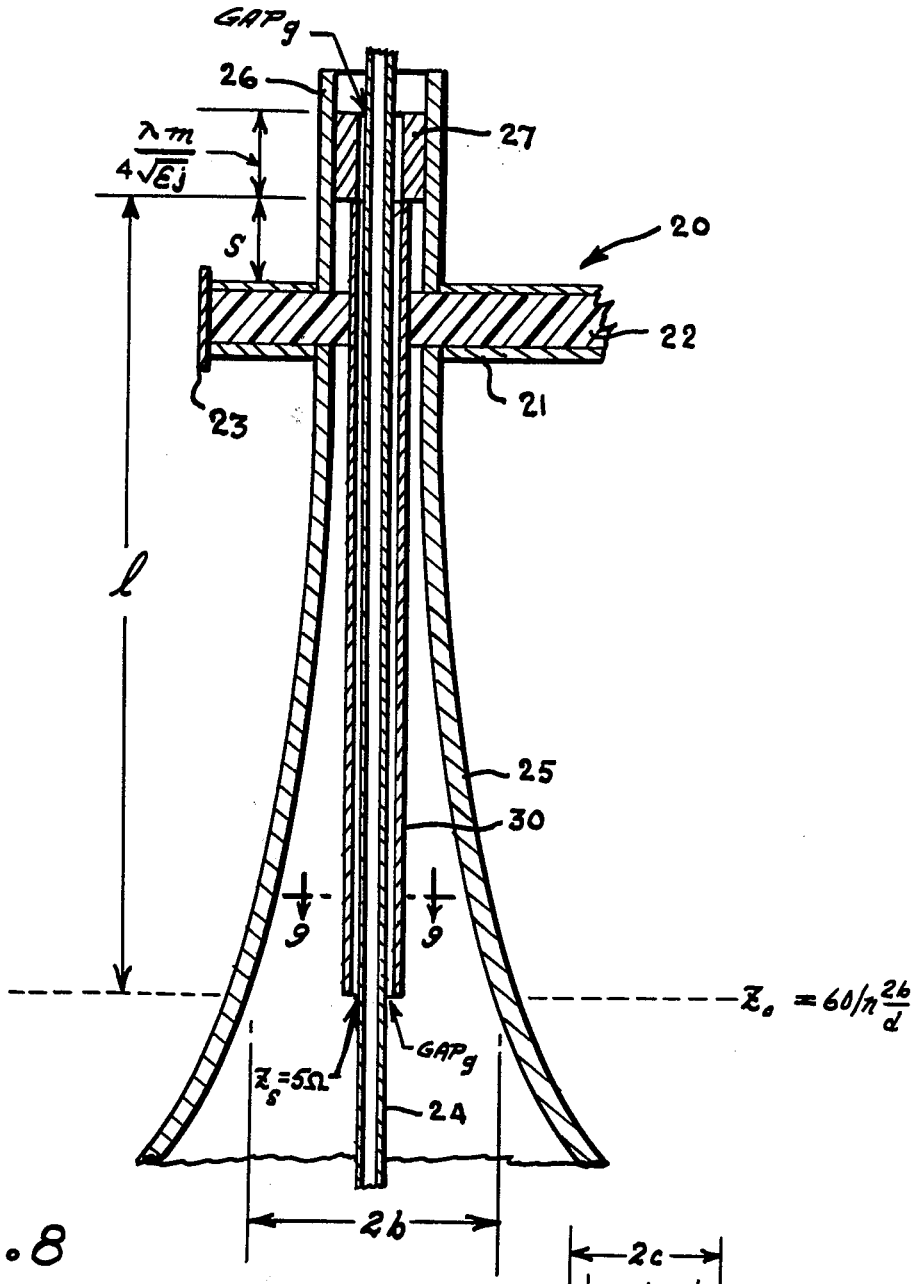
FIG. 8 illustrates another embodiment of the invention.
Figure 9:
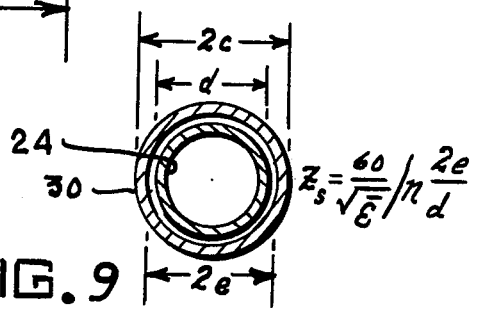
FIG. 9 is a sectional view of the embodiment of FIG. 8 taken at 9—9.

Another embodiment of the invention is illustrated by FIGS. 8 and 9. In this embodiment the gap g is moved to a higher impedance region by means of sleeve 30, thereby reducing the relative importance of gap leakage in proportion to $$\frac{P_{gap}}{P_o} \sim \frac{Z_{gap}}{Z}$$

Thus, a 5 ohm gap in a 50 ohm circuit extracts 10% of its energy. Moving the gap down stream near the transmission line launch point where the characteristic impedance is $Z \sim 200$ ohms results in $$\frac{P_{gap}}{P_o} \sim \frac{5}{200} = 2\tfrac{1}{2}\% \text{ wasted}$$

In practice, of course, gap impedance may be reactively or resistively loaded.

The principles of the invention are also adapted to a novel microwave device for permitting efficient r.f. transfer with unlimited translation on one dimension, and which by analogy with rotary joints may be termed a translational joint. FIG. 10 schematically illustrates such an apparatus. In this application the elliptical couplers 33, 34 are used in pairs. In the arrangement shown in FIG. 10 the transmission line 24 is slidably coupled to coupler 33 at the output and to coupler 34 at the input. Typical uses of this paired coupler device would be tracked transit and rail system. In particular it could be applied effectively to tracked antenna ranges for efficient transfer of local oscillator power at 1–2 Ghz between receiver and mixers.

Paired coupler devices can also be utilized in accordance with the principles of the invention as a means for coupling microwave power onto electrical cables while in manufacture, in situ, for quality control purposes. FIG. 11 illutrates this application of the invention. R.F. test loops 35, 36 operating from couplers 40, 41 and 42, 43 respectively are set up and electronically isolated from the cable extrusion and braiding operations of extruding head 37 and jacket tape laying machine 38 as shown. Cable electrical properties, dielectric constants and losses, braid resistance and other parameters can in this way be measured and used in turn for quality control.

While the invention has been described in terms of its preferred embodiments it is understood that the words which have been used are words of description rather than words of limitation and that changes within the purview of the appended claims may be made without departing from the scope and spirit of the invention in its broader aspects.

What is claimed is:

1. A coupler for coupling a fixed r.f. signal source to a sliding transmission line comprising:

a planar elliptical cavity of electrically conductive material, input means inputting an r.f. signal at a point connecting with one focus of said elliptical cavity, an r.f. transmission line slidably extending through an aperture coinciding with the other focus of said elliptical cavity, the distance between ellipse foci being one half wavelength less than the length of the ellipse's major axis.

2. A coupler for coupling a fixed r.f. signal source to a sliding transmission line as defined in claim 1 wherein the length between ellipse foci is equal to one half wavelength at the coupler operating frequency.

3. A coupler for coupling a fixed r.f. signal source to a sliding transmission line as defined in claim 2 wherein said input means is connected to a quarter wavelength stub extending from the distal planar side of said elliptical cavity.

4. A coupler for coupling a fixed r.f. signal source to a sliding transmission line as defined in claim 3 including a signal launcher horn extending from a planar surface of said elliptical cavity and encompassing said r.f. transmission line.

5. A coupler for coupling a fixed r.f. signal source to a sliding transmission line as defined in claim 4 including an r.f. choke engaged to said elliptical cavity and encompassing said r.f. transmission line.

6. A coupler for coupling a fixed r.f. signal source to a sliding transmission line as defined in claim 5 including a sleeve member of electrically conductive material engaged to said elliptical cavity and encompassing said r.f. transmission line.

7. A coupler for coupling a fixed r.f. signal means to a sliding transmission line as defined in claim 6 wherein said r.f. transmission line is a single conductor surface wave transmission line.

8. An input-output r.f. signal coupling means to provide translational coupling to a transmission line comprising a first coupler for coupling an input r.f. signal to said transmission line said first coupler comprising a planar elliptical cavity of electrically conductive material, and input means inputting an r.f. signal at a point coinciding with one focus of said elliptical cavity, said transmission line extending through an aperture coinciding with the other focus of said elliptical cavity, the distance between ellipse foci being one half wavelength less than the length of the ellipse's major axis, and a second coupler for coupling an output r.f. signal from said transmission line, said second coupler comprising a planar elliptical cavity of electrically constructive material, said transmission line extending through an aperture coinciding with one focus of the elliptical cavity of said second coupler and an r.f. signal output means coupling an r.f. output signal from a point of the elliptical cavity of said second coupler coinciding with the coupler's other focus, the distance between ellipse foci of said second coupler being one half wavelength less than the length of its major axis.

* * * * *